US005458434A

United States Patent [19]

Bent et al.

[11] Patent Number: 5,458,434

[45] Date of Patent: Oct. 17, 1995

[54] PLASTIC BARRICADE WITH HANDLE AND ENGAGABLE STACKING LUG

[75] Inventors: Bruce C. Bent; James A. Bent, both of Huntington Beach, Calif.

[73] Assignee: Bent Manufacturing Company, Huntington Beach, Calif.

[21] Appl. No.: 331,885

[22] Filed: Oct. 31, 1994

[51] Int. Cl.[6] ..... E01F 13/00

[52] U.S. Cl. ..... 404/6; 404/9; 404/10; 40/610; 40/612

[58] Field of Search ..... 52/174; 40/606, 40/612, 610, 6, 9, 10, 12; 14/2.4, 2.5; 404/6, 9, 10, 12; 256/1, 13.1

[56] References Cited

U.S. PATENT DOCUMENTS

| | | |
|---|---|---|
| D. 60,293 | 1/1922 | Meden . |
| D. 235,744 | 7/1975 | England . |
| D. 272,809 | 2/1984 | Bent et al. . |
| D. 276,510 | 11/1984 | Bent et al. . |
| D. 279,275 | 12/1983 | Cory . |
| D. 320,172 | 9/1991 | Thurston . |
| 2,456,685 | 12/1948 | Delmotte . |
| 2,483,734 | 10/1949 | Neal . |
| 2,649,803 | 8/1953 | Andre . |
| 2,762,327 | 9/1956 | Weig . |
| 2,762,328 | 9/1956 | Weig . |
| 2,808,803 | 10/1957 | Weig . |
| 2,817,308 | 12/1957 | Scanlon . |
| 2,957,444 | 10/1960 | Boettler . |
| 3,099,244 | 7/1963 | Knapp . |
| 3,231,994 | 2/1966 | Cyrus . |
| 3,380,428 | 4/1968 | Abrams . |
| 3,451,368 | 6/1969 | Keats . |
| 3,499,413 | 3/1970 | Heard . |
| 3,520,235 | 7/1970 | Palazzolo et al. . |
| 3,563,445 | 2/1971 | Clayton . |
| 3,619,443 | 11/1971 | Blandford-Feldman . |
| 3,664,085 | 5/1972 | Rousseau et al. . |
| 3,675,811 | 12/1972 | Artz . |
| 3,701,456 | 10/1972 | Alroy . |
| 3,751,852 | 8/1973 | Schrepper . |
| 3,794,090 | 2/1974 | Commisso . |
| 3,809,007 | 5/1974 | Brown . |
| 3,822,668 | 7/1974 | Schradieck et al. . |

(List continued on next page.)

FOREIGN PATENT DOCUMENTS

| | | |
|---|---|---|
| 216329 | 12/1956 | Australia . |
| 665785 | 1/1952 | United Kingdom . |
| 1058881 | 2/1967 | United Kingdom . |
| 1301084 | 12/1972 | United Kingdom . |
| 2077332 | 12/1981 | United Kingdom . |
| 2081348 | 2/1982 | United Kingdom . |
| 2090313 | 7/1982 | United Kingdom . |
| 2122239 | 1/1984 | United Kingdom . |
| 2156409 | 10/1985 | United Kingdom . |
| 2182701 | 5/1987 | United Kingdom . |

OTHER PUBLICATIONS

Doc. #B0384 Thru B0391—Produced By Best Barricades As Sales Brochure. Dated prior to 1992. Total Of 8 Pages. Produced In Rolling Meadows, Ill.

Doc. #11215—Produced By Safety Cade As Sales Brochure. Dated Prior To 1991, One Page Only. Produced In Addison, Ill.

Doc. #11207 Thru 11214—Produced By Flasher Flare South East, Inc. As A Price List. Dated Oct. 17, 1991, Total Of 8 Pages. Produced in Hillsborough County, Fla.

Doc. #11346 Thru 11352—Produced By Traffic Safety Service As Sales Brochure, Dated Prior To 1991, Total Of 7 Pages. Produced In South Plainfield, N.J.

*Primary Examiner*—Ramon S. Britts
*Assistant Examiner*—Pamela A. O'Connor

[57] ABSTRACT

A plastic barricade is formed from identical panels placed back to back and hinged together. Each panel includes a handle at the top, vertical legs with reinforcing ribs, and horizontal cross-members. The bottom most horizontal cross-member includes a stacking lug that may be inserted into the handle to prevent a stack of barricades from tipping over. The barricade may also be designed to be compatible with existing barricades.

7 Claims, 3 Drawing Sheets

U.S. PATENT DOCUMENTS 3,825,114 7/1974 Johnston et al. .
3,916,816 11/1975 Fitch .
3,949,701 4/1976 Teixeira .
3,950,208 4/1976 Pavuk et al. .
3,952,690 4/1976 Rizzo et al. .
4,006,702 2/1977 St. Cyr .
4,007,919 2/1977 Totten .
4,026,086 5/1977 Langley .
4,040,759 8/1977 Skalle .
4,053,100 10/1977 Baptist .
4,054,207 10/1977 Lazure et al. .
4,083,033 4/1978 Kulp .
4,102,453 7/1978 Carroll et al. .
4,120,398 10/1978 Braddon, Sr. .
4,134,533 1/1979 Heavner .
4,175,661 11/1979 Barnes .
4,184,604 1/1980 Amberg et al. .
4,197,808 4/1980 Kinninger .
4,239,137 12/1980 Arcouette .
4,256,050 3/1981 Barnard .
4,291,830 9/1981 Sorenson .
4,298,186 11/1981 Glass .
4,317,617 3/1982 Charlton .
4,329,800 5/1982 Shuman .
4,334,616 6/1982 Wilson .
4,349,147 9/1982 Jensen .
4,418,863 12/1983 Kimbrell, Sr. .
4,441,600 4/1984 Caray .
4,441,615 4/1984 Goodrich .
4,466,376 8/1984 Wells .
4,516,109 5/1985 Thurston .
4,520,928 6/1985 Wilson .
4,570,798 2/1986 Wilson .
4,624,210 11/1986 Glass .
4,674,431 6/1987 Cory .
4,792,258 12/1988 Goff .
4,852,511 8/1989 Look et al. .
5,003,912 4/1991 Thurston .
5,009,541 4/1991 Thurston .
5,036,791 8/1991 Thurston .
5,046,885 9/1991 Thurston .

10
12
18
20
22
26
28
30
32
36
38
40
42
44
48
50
52
54
58

PLASTIC BARRICADE WITH HANDLE AND ENGAGABLE STACKING LUG

BACKGROUND OF THE INVENTION

This invention relates generally to traffic delineators, and more particularly to a stackable plastic barricade for traffic delineation purposes.

The development of plastic traffic delineation devices, such as plastic barricades, has significantly increased the safety of automotive transportation. If a wood or metal barricade is struck by an automobile, the automobile may be seriously damaged, causing injury to the occupants of the automobile, and the barricade may be destroyed. If an automobile strikes a plastic barricade, the resilient, lightweight barricade causes significantly less damage to the vehicle, which reduces the risk of injury to the vehicle occupants, and the barricade is often not seriously damaged.

For ease of manufacture and use, plastic barricades are often made in two identical pieces. To assemble the barricade, one of the pieces is rotated about its lengthwise axis and matched to the other piece. Bolts are typically used to hinge the two pieces together.

One of the problems with plastic barricades is that of stacking. The plastic is smooth, and so when stacked the barricades have a tendency to slide off. To solve this problem, stacking lugs have been added to faces of the barricades. Previously, barricades have been sold that included two small circular stacking lugs formed near the top of the face of each piece, with two circular indentations near the bottom of each face in which the stacking lugs were inserted when the barricades were stacked. Another design, depicted in U.S. Pat. No. 5,003,912, included rectangular stacking lugs and corresponding indentations along the vertical supports of the barricades.

These prior stacking lug mechanisms had disadvantages. For instance, when barricades having the lugs were stacked, the lugs on the bottom face of the bottom barricade were often crushed by the weight of the barricades. This resulted in the stacking lug being deformed and unusable.

In a warehouse, workers could avoid crushing the stacking lugs by using specially designed pallets that had gaps at positions in which the stacking lugs could be inserted. However, these special pallets are more expensive than regular pallets and require special handling by the workers. Furthermore, in construction areas, no such pallets are used, and thus the stacking lugs frequently were crushed.

Signs are often mounted on the front face of plastic barricades. Stacking lugs positioned along the vertical legs of the barricades interfere with such signs, preventing the sign from laying flat against the face of the barricade. As a result, when securely mounted to the barricade, a sign may bend, bow or misalign.

SUMMARY OF THE INVENTION

According to the present invention, a plastic barricade is provided that overcomes these and other drawbacks of the prior barricades. A barricade made according to the present invention is inexpensive to manufacture and interchangeable with existing barricades. Furthermore, a barricade according to the present invention includes a stacking lug that is significantly less likely to be crushed or otherwise destroyed in use, yet remains easily used.

The barricade according to the present invention is preferably formed from two identical panels of blow molded plastic. The panels are hinged together at the top. Thus, the barricade may be opened by swinging the two panels apart at the bottom, or closed by putting the two panels together.

Each panel has horizontal cross-members that extend between vertical legs. The legs of the barricade have reinforcing ribs to provide additional strength. A handle is formed on the top surface of the uppermost horizontal cross-member by including a loop of plastic large enough for a hand to be inserted. Each panel has an identical loop handle, so that when the barricade is opened, a hand may be inserted through both loops to grip the barricade.

Near the bottom of each panel a horizontal cross-member is formed between the vertical legs of the panel. A stacking lug is formed on the outside face of that horizontal cross-member. The stacking lug is shaped to fit into the handle. Thus, the barricades may be stacked with the lug inserted into the hole formed by the handle.

BRIEF DESCRIPTION OF THE DRAWINGS

Other features and advantages of the present invention will be apparent from the following Detailed Description taken in conjunction with the accompanying Drawings, in which.

DETAILED DESCRIPTION

Figure 1:
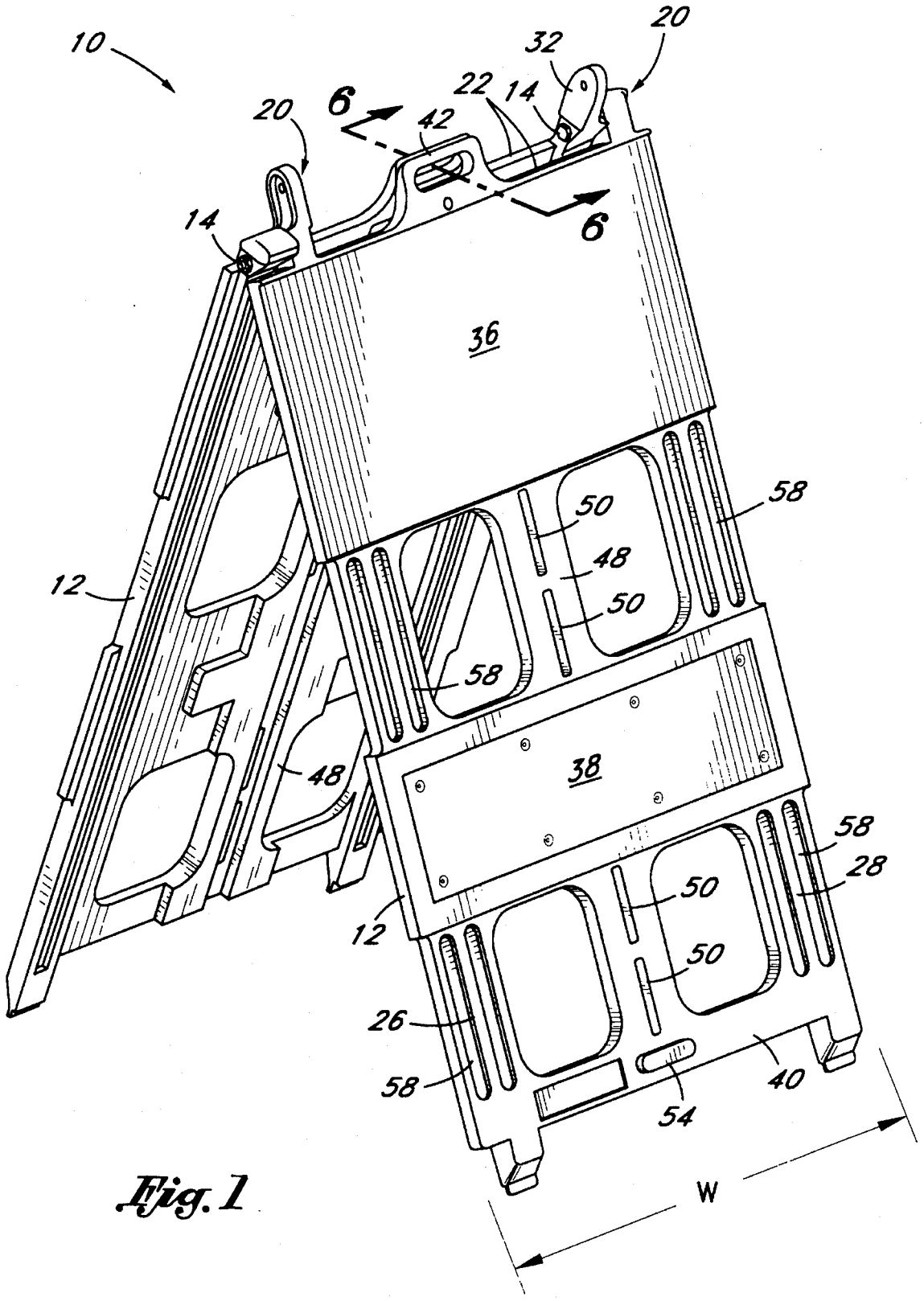
FIG. 1 is a perspective view of the barricade of the present invention.

As shown in the drawings, the present invention is embodied in a barricade 10. The barricade 10 is assembled from two identical panels 12 that are preferably made of blow-molded plastic. Preferably, the panels are hollow and may be filled with ballast, such as sand, if desired.

Each panel 12 is blow-molded using an identical die. After the panels cool, two panels are placed together back to back. Bolts 14 are inserted through bolt holes 18 formed in hinges 20 that extend above the top edge 22 of the panels 12.

Each panel 12 is formed with a left side vertical leg 26 and a right side vertical leg 28. As depicted best in FIG. 4, these vertical legs have reinforcing ribs 30 formed in the back face of the legs to provide strength to the legs. The reinforcing ribs extend outwardly from the back of the plastic panel 12 and form additional vertical faces to create a vertical leg with greater support and strength. A molded light bracket 32 is formed on the upper end of the left side vertical leg.

As depicted in FIG. 1, the barricade 10 has three horizontal cross-members 36, 38, and 40 formed between the left side vertical leg 26 and the right side vertical leg 28. The topmost horizontal cross-member 36 is preferably the widest of the three cross-members. The topmost cross-member includes a large surface on the front face of the panel for affixing retroreflective sheeting or other material.

Figure 6:
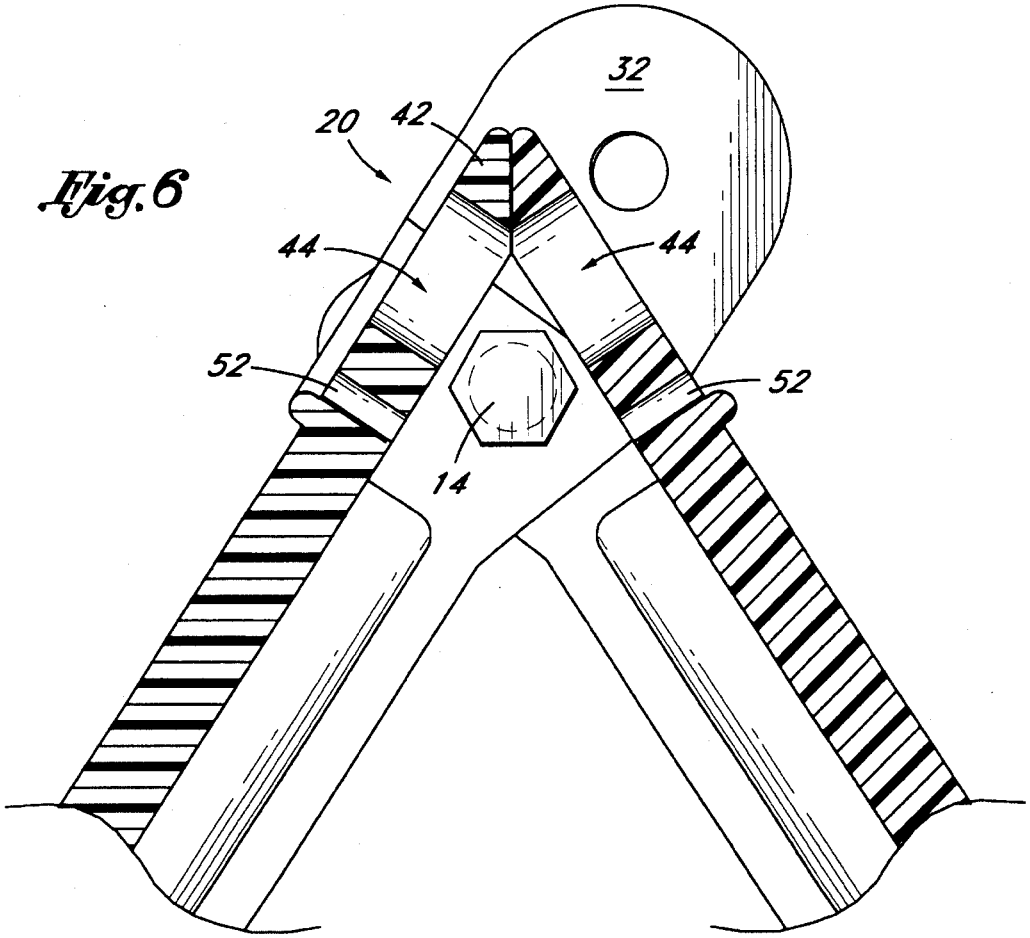
FIG. 6 is a cross-sectional view of an upper portion of the barricade taken along the line 6—6 shown in FIG. 1.
Figure 7:
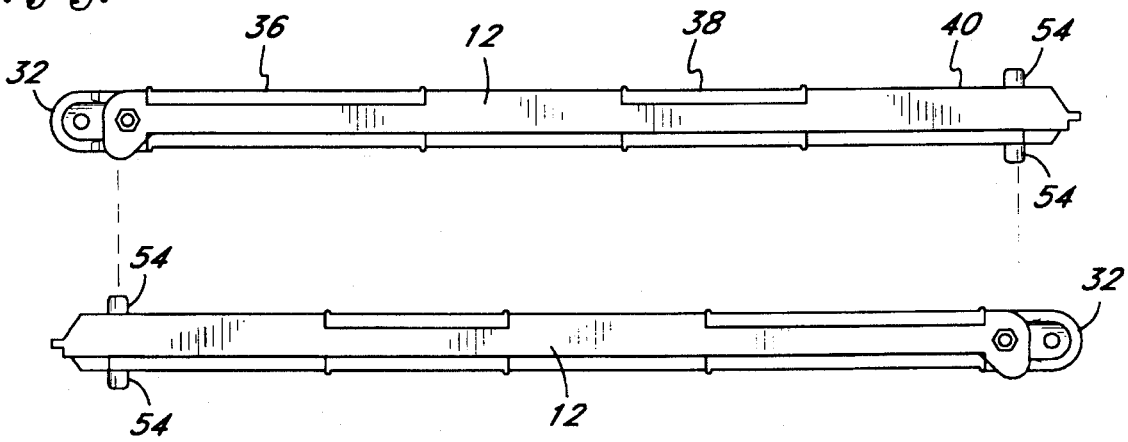
FIG. 7 is a side view of the barricade of FIG. 1 showing the method of interlocking the stacking lugs.

A handle 42 is formed in the top edge of the panel 12. The handle is basically a loop of plastic that extends up from the center of the topmost horizontal cross-member 36. As depicted in FIG. 6, when the barricade 10 is opened, the two handles formed in the two panels 12 align. As a result, a person may insert a hand into the hole 44 formed by the handle and thereby grasp and carry the barricade 10.

The middle horizontal cross-member 38 is preferably used to mount signage or an identification of the owner of the barricade 12. To assist in mounting signage, a third vertical leg 48 is formed approximately midway between the left side vertical leg 26 and the right side vertical leg 28. This third vertical leg 48 is formed with vertical bolt slots 50 therein. Because the bolt slots are vertical, the signage may be mounted at various vertical levels on the barricade 12. A bolt hole 52 formed on top of the panel 12 just under the handle 42 may be used to mount a sign to the barricade 10.

Figures 2, 3, 4, 5:
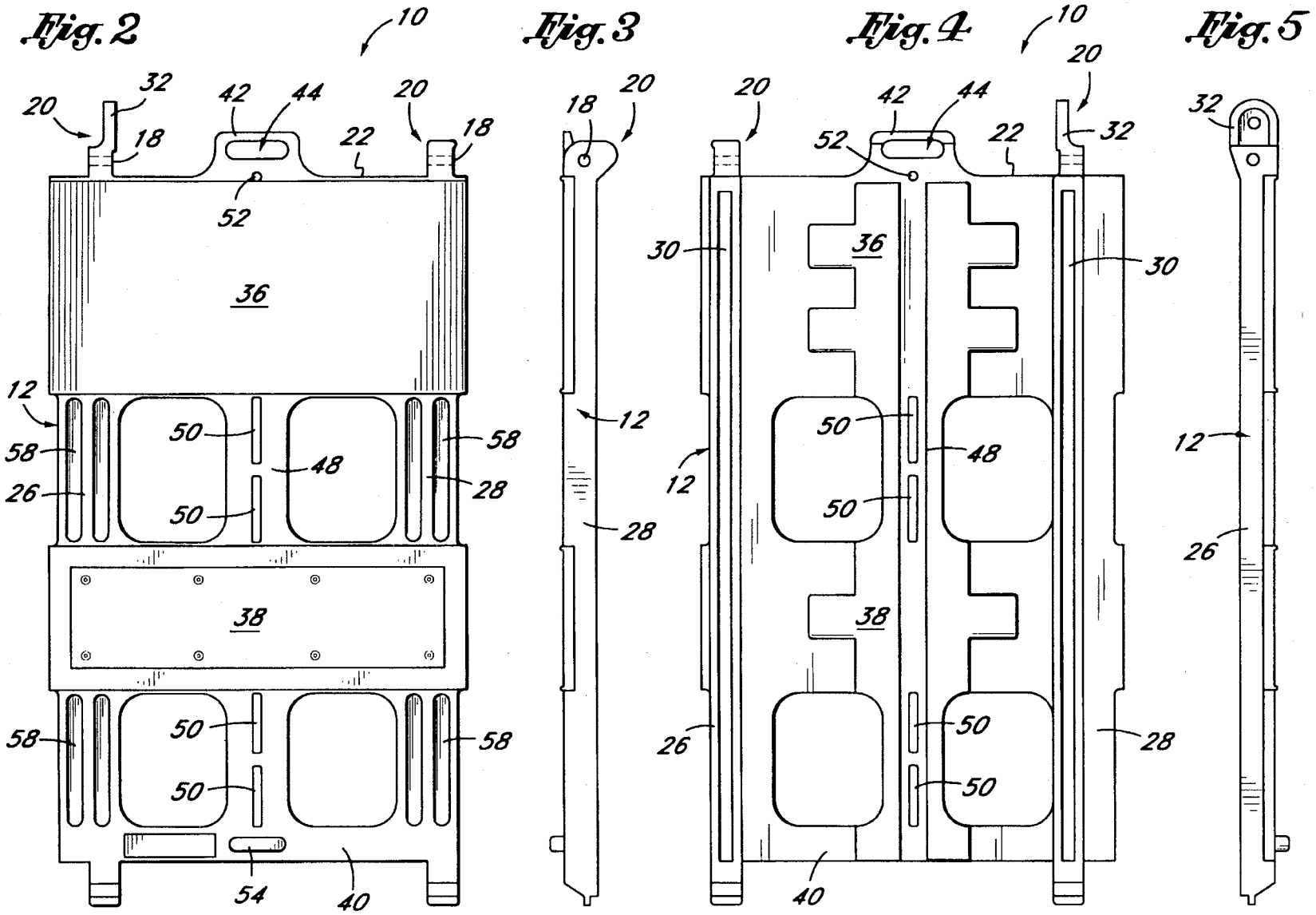
FIG. 2 is a plan view of the outer face of one panel of the barricade of FIG. 1.
FIG. 3 is a right side view of the panel shown in FIG. 2.
FIG. 4 is a plan view of the inner face of the panel of the barricade of FIG. 1.
FIG. 5 is a left side view of the panel shown in FIG. 2.

As perhaps best depicted in FIG.2, the bottom horizontal cross-member 40 extends between the left side vertical leg 26 and the right side vertical leg 28 and forms the bottom of the middle vertical leg 48. The bottom horizontal cross-member 40 provides lateral support for the barricade 10. The bottom cross-member may also be used as a sandbag bar so that sand bags may be used as ballast to hold the barricade in position.

The bottom horizontal cross-member 40 includes an outwardly protruding stacking lug 54 formed on the front face of the panel 12. This stacking lug 54 is formed with about the same dimensions as the hole 44 in the handle 42. As a result, the stacking lug 54 may be inserted into the hole 44 of the handle 42.

The barricades 10 according to the present invention may be stacked by alternating the longitudinal orientation of respective barricades. In other words, each barricade is placed on top of another barricade so that the hole 44 formed in the handle 42 aligns with the stacking lug 54 of the adjacent barricade. Inserting the stacking lug 54 into the handle hole 44 will reduce slippage of the barricades when stacked.

The stacking lug 54 provides additional advantages. Often, a sign affixed to a barricade 10 will slip down to the ground. The stacking lug 54 acts as a base for such signs. The stacking lug may also be used as an extruded handle for a worker to hold the barricade 10 from the bottom.

As depicted in FIG. 2, the vertical legs 26 and 28 may also be formed with reinforcing ribs 58 in the front face of the panel 12. These reinforcing ribs provide additional strength to the barricade 10. Furthermore, these ribs can be formed to interact with the stacking lugs on existing barricades that get crushed when stacking. As a result, barricades 10 made in accordance with the present invention may be used in the bottom of stacks of other barricades and both interact with existing handles on earlier barricades and also prevent crushing of the stacking lugs on the prior barricades. This provides a significant cost savings because the workers need not segregate the various models of barricades.

Although one embodiment of the invention has been illustrated and described, various modifications and changes may be made by those skilled in the art without departing from the spirit and scope of the invention.

We claim:

1. A plastic traffic delineation barricade assembled from two substantially similar generally planar one piece, hollow, integrally blow-molded plastic panels hinged together to pivot around a common axis of rotation by one or more bolts extending through one or more bolt holes formed in hinge members integrally molded on said panel, each of said panels being manufactured by a plastic molding process using an identical die, each of said panels having an outward facing front face with left and right and top and bottom edges when viewed by an observer, each panel comprising:

a first horizontal cross-member proximate the top edge of the panel;

means for forming a pair of hinges along the top edge of the panel to hinge two panels together in back to back relationship;

a handle that includes means forming a hole and that is molded on the first horizontal cross-member along the top edge of the panel;

a bolt hole formed in the first horizontal cross-member below the handle for use in affixing signs to the barricade;

a second horizontal cross-member below the first pane;

first and second vertical legs proximate the right and left edges, respectively, of the panel, at least one of which includes a molded light bracket for attaching a light onto the top of the barricade, each of the first and second legs having:

extended foot portions proximate the bottom edge of the panel for contacting the ground and leaving a space between the ground and the third horizontal cross-member;

reinforcing ribs formed in the front face of the legs proximate the left and right edges of the panel; and reinforcing ribs formed along the back face of the legs;

a third vertical leg formed between the first and second vertical legs, the third leg having a reinforcing rib along the back face and a plurality of vertical bolt slots for use in mounting signage to the front face of the panel; and a third horizontal cross-member extending between the first and second legs proximate the bottom edge of the panel, the third cross-member having a stacking lug for engaging with the hole formed by the handle when the barricade is stacked onto another barricade having a similar handle, the stacking lug having a dimension and shape to be inserted into, but be freely separable from, the hole formed by the handle.

2. A plastic traffic delineation barricade assembled from two panels hinged together to pivot around a common axis, each of said panels having an outward facing front face with left and right and top and bottom edges when viewed by an observer, each panel comprising:

first and second vertical legs proximate the right and left edges, respectively, of the panel;

a top horizontal cross-member extending between the first and second vertical legs;

a handle; and a horizontal cross-member extending between the first and second legs and including a stacking lug for engaging with a hole formed by the handle when the barricade is stacked onto another barricade having a similar handle.

3. The barricade of claim 2 further comprising reinforcing ribs formed in the first and second legs.

4. The barricade of claim 2 further comprising a third vertical leg formed between the first and second vertical legs, the third leg having a reinforcing rib along the back face and a plurality of vertical bolt slots for use in mounting signage to the front face of the panel.

5. The barricade of claim 2 further comprising means for forming a pair of hinges along the top edge of the panel to hinge two panels together in back to back relationship.

6. The barricade of claim 2 further comprising a light bracket for attaching a light onto the top of the barricade.

7. The barricade of claim 2 further comprising extended foot portions on the first and second vertical legs proximate the bottom edge of the panel for contacting the ground and leaving a space between the ground and the bottom horizontal cross-member.

* * * * *